US005634575A

United States Patent [19]

Scharrenberg

[11] Patent Number: 5,634,575

[45] Date of Patent: Jun. 3, 1997

[54] APPARATUS AND METHOD OF REFORMING VISORS OF BASEBALL CAPS

[76] Inventor: Jim Scharrenberg, 10607 Carls Rd., Marengo, Ill. 60152

[21] Appl. No.: 450,424

[22] Filed: May 25, 1995

[51] Int. Cl.[6] ..... D06C 15/00

[52] U.S. Cl. ..... 223/84; 223/24; 223/25

[58] Field of Search ..... 223/84, 52, 24, 223/25, 26

[56] References Cited

U.S. PATENT DOCUMENTS

| | | | |
|---|---|---|---|
| 2,492,264 | 12/1949 | Boyle | 223/84 |
| 2,786,615 | 3/1957 | Saibene | 223/25 |
| 3,402,865 | 9/1968 | Moreau | 223/84 |
| 4,607,769 | 8/1986 | DeLisle et al. | 223/25 |
| 5,163,589 | 11/1992 | Biehl | 223/24 |

FOREIGN PATENT DOCUMENTS

| | | | |
|---|---|---|---|
| 163760 | 8/1949 | Austria | 223/25 |

*Primary Examiner*—Bibhu Mohanty

*Attorney, Agent, or Firm*—R. Winston Slater

[57] ABSTRACT

Apparatus and method for reforming a visor of a baseball type cap including a flexible member to be positioned adjacent the visor and having retention plates along the sides or center thereof that form visor receiving slots to position and retain the visor during reforming. Clips may be used in lieu of slots to retain the visor. Straps or similar elongated devices are affixed to the sides of the flexible member and are tensioned to draw said sides together thereby imparting an increased angular contour to the visor. Latches on the straps hold the desired tension and visor contour until the visor has assumed the new contour set. The method may include moisturizing the visor and may be performed iteratively to permit various intermediate contours to be sampled or as required to provide the desired semi-permanent visor set.

19 Claims, 3 Drawing Sheets

APPARATUS AND METHOD OF REFORMING VISORS OF BASEBALL CAPS

BACKGROUND OF THE INVENTION

The present invention relates to baseball caps and similar headgear having bills or visors thereon and, in particular, to apparatus for, and a method of, 'breaking in' the bills on such caps to form a curved visor contour. Most cap wearers prefer, whether for mere style or for the salutary benefits of shielding sun and rain, to have the bill of their cap curved, with its outer edges sloping downwardly from the center. And despite obvious attempts of cap manufacturers to provide the desired contour, the visors of most new caps remain unacceptably flat.

The present invention defines an inexpensive mechanism and method that permits the bending of a hat bill into a wide range of user-selectible curvatures. The user is not required to adopt any particular or current style nor any 'industry' standard contour. The user may, in fact, 'experiment' with differing styles by successively altering visor curvature until the desired bending contour is attained.

Cap brims or bills generally exhibit what is known as 'memory'. Memory is defined as the tendency of the bill to return to its preformed comparatively flat contour, i.e. the contour that existed upon manufacture. It will be appreciated that the apparatus and method of this invention may be applied to the bill as often as required in order to maintain or return the bill to the desired shape.

Further, the present apparatus may be used for cap storage, for example in a closet or the like. In this context the bill is returned to (i.e. placed within) the present bill forming apparatus during periods of non-use. This 'storage function' serves, in turn, to maintain the bill in its desired contour by automatically 're-forming' it each time the hat is stored thereby overcoming any bill 'memory' and more permanently defining the desired bend therein.

Numerous arrangements for bending and forming hat brims and bills have been shown. One early example is U.S. Pat. No. 370,963 to Materne in which a circumferential brim is given an upward curvature through the use of a press or die. The Materne press is employed during initial fabrication and does not provide for adjustment, user field use, nor hat storage. Similar teachings are shown in U.S. Pat. Nos. 2,259,930 to Gawelek and 2,556,016 to Turshin.

U.S. Pat. No. 1,207,407 to Hutter is another circumferential or "annular" brimmed hat in which the crown and the inner brim are fixed-formed by the use of "dies". The outer brim, however, is fabricated of a "flexible or pliable material" permitting the user to adjust the shape thereof. Hutter contemplates that such shape adjustment be achieved by hand without "being subjected to" use of external "die" apparatus.

Another apparatus for forming baseball cap-type "visors" is shown in Grommes, U.S. Pat. No. 4,708,271. Grommes provides a fixed curvature "support plate" on which the visor rests. The "front area" of this support plate may optionally be employed to form the visor (the principal thrust of Grommes is the formation of the cap "head piece"). Rubber bands are employed to hold and bias the visor against the fixed contour support plate.

Yet another arrangement for shaping baseball cap bills is shown in Otteson, U.S. Pat. No. 5,161,719. Like Grommes, Otteson provides for the shaping of both the head piece and the visor. More specifically, a three-point bill-forming frame is taught in which a "bendable wire" defines a pair of spaced "hooks" that grasp respective visor sides and bias the visor against a center "brace". Adjustment may be effected by "bending" the wire comprising the frame. Finally, Biehl, U.S. Pat. No. 5,163,589, teaches a hinged press arrangement. But Biehl, too, is limited to a predetermined fixed curvature.

The bill bender of the present invention employs a flexible retention system of variable and adjustable curvature where, as noted, the bill retained thereby can be contoured to any curvature. In one embodiment of the invention, the bill retention system is comprised of a pair of upper and lower flexible, generally planar members that are spaced apart and mounted along a portion of their respective perimeters in substantially parallel relationship thereby defining a slot therebetween for the receipt and retention of the cap bill. The cap bill is inserted into the slot and thereafter contoured as set forth below.

In another embodiment, the retention system employs a single flexible member with a pair of bill clamping mechanisms disposed along the opposed sides of the flexible member for grasping the corresponding edges of the bill. In yet another embodiment, a single bill clamping mechanism is disposed generally in the center of, again, a single flexible member to rigidly retain the center portion of the bill to the flexible bill bender member.

In all of these embodiments, an adjustable tensioning device is attached to, and disposed between, the respective opposed lateral sides of the flexible member whereby, by applying tension thereto, the otherwise generally planar flexible member is urged into an increasingly contoured C-shape in a manner analogous to that of a bow-string as it serves to tension and force the bending of the bow connected thereto. The present invention contemplates virtually any form of tensioning device including adjustable straps with buckles or Velcro™ or even the use of string ties.

The method of the present invention includes the placement of the bill into the slot of the flexible retention system or, alternatively, placement of the bill adjacent the flexible member with the opposed, or central, clamping mechanisms engaging and retaining the bill thereto. The bill may advantageously be moistened prior to insertion into the present bill bender apparatus. Such pre-moisturization hastens the bending process and generally lessens the degree of memory exhibited by the bill. The bill, in short, may more readily take a 'set', that is, retain a curvature for a longer or near permanent duration.

Following attachment of the cap bill to the present bill bender, the tensioning device is 'tensioned' to begin to draw the opposed sides of the flexible members (and the bill retained in fixed orientation with respect thereto) together. The bill assumes an increasingly curved contour as tensioning progresses. The bill is preferably maintained within the bill bender for a period of several hours to assure that a proper 'set' is taken by the bill and, in the case where moisture has been applied, to permit the evaporation thereof.

The tensioning device may be relaxed to aid in the release of the bill or, if it is intended to utilize the present bill bender as a closet hat rack, the hat may be removed while maintaining the bill bender in its previously set curvature. The bill may be reinserted at any time into the bill bender for hat storage or to re-apply the selected bill curvature. The above process may be undertaken in incremental steps to permit the hat owner to sample selected contours and to thereafter increase the contour if the previously selected configuration is not satisfactory.

It is an object of the present invention to provide apparatus and a method for reforming the visors of baseball-type caps to thereby give them the proper or user-desired curvature, such curvature often being associated with caps that have been in service for a period of time and are therefore 'broken in'. It is an object that the present apparatus and method be simple to use (i.e. without training) and that extrinsic equipment or tools not be required. It is an object of the present invention that the apparatus be comparatively inexpensive and light weight. It is an object that the apparatus and method may be repeatedly applied to a given visor either as required to achieve the desire contour or iteratively to permit the user to sample and experiment with differing contours. It is an object of the present invention that it may be used not merely to initially form the cap visor, but thereafter in a storage capacity, for example, as a rack in a closet. It is an object that such storage further serves to maintain the selected visor contour. It is an object that the present apparatus may simply be placed on a shelf of a closet for storage, or it may include a mounting post clamped to the shelf, or a hook for hanging within the closet.

These and other objects are more fully explicated in the drawings, specification, and claims that follow.

DESCRIPTION OF THE PREFERRED EMBODIMENT

Figure 1:
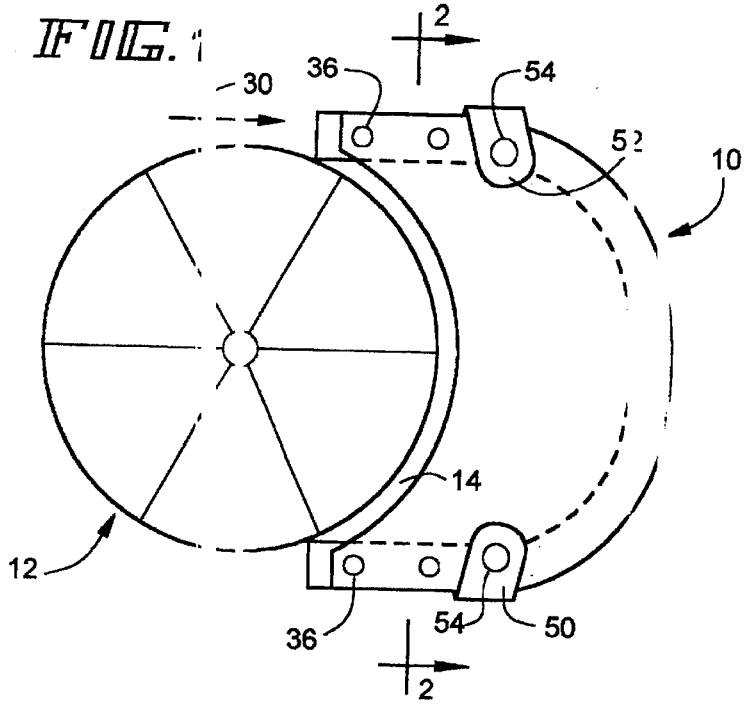
FIG. 1 is a horizontal plan view of the hat visor forming apparatus of the present invention shown in position on the visor of a typical baseball cap.
Figure 4:
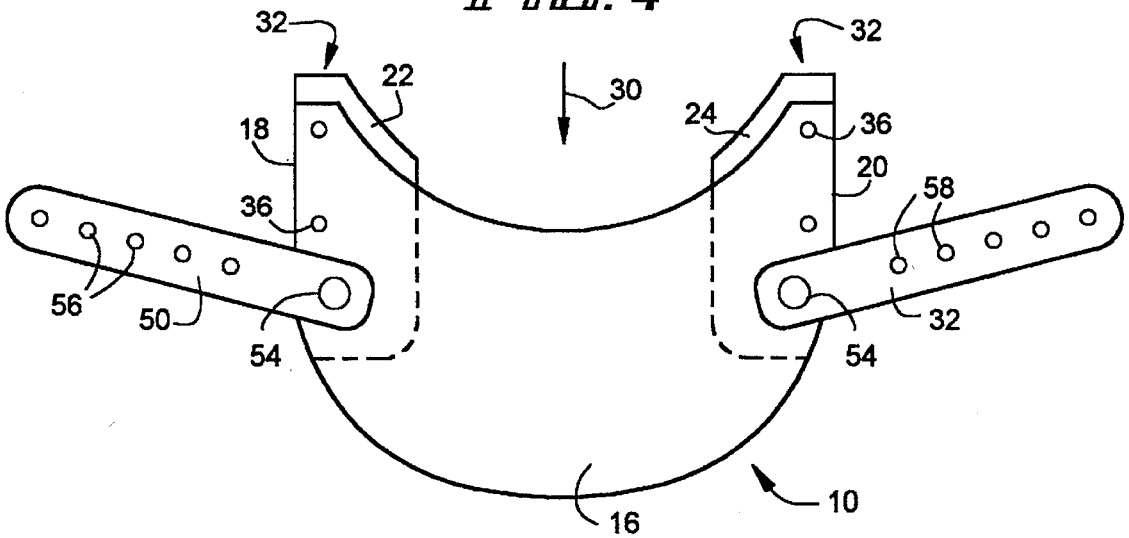
FIG. 4 is a plan view of the hat visor forming apparatus of FIG. 1 separately shown without a hat inserted therein.

FIGS. 1 and 4 illustrate the hat visor forming apparatus or 'bill bender' 10 of the present invention as it is positioned for use on a typical baseball type cap 12 including cap visor or bill 14. The cap visor 14 is inserted into bender 10 in the direction depicted by arrow 30.

With particular reference to FIG. 4, bender 10 is preferably constructed using a flexible upper member 16 of width (top-to-bottom as depicted in FIG. 4) suitable to assure that respective side edges 18 and 20 thereof are disposed outwardly, i.e. overhang, the corresponding side edges of visor 14. Upper member 16 may advantageously be stamped or die-cut from a sheet of flexible plastic material although any flexible material such as thin gauge aluminum or other metal may be employed.

Figure 2:
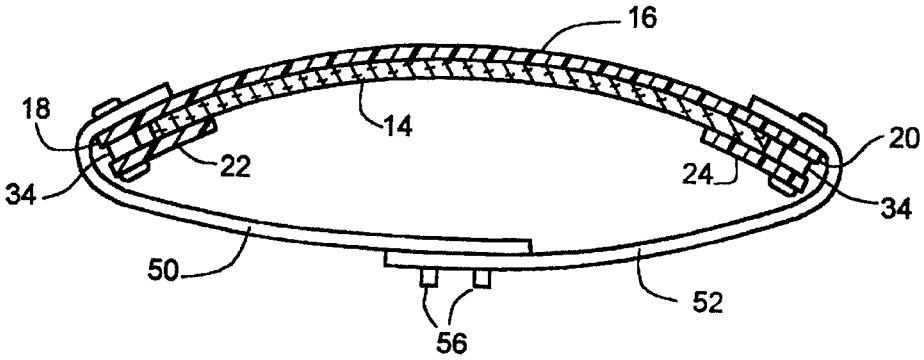
FIG. 2 is a sectional view of the visor forming apparatus taken along line 2—2 of FIG. 1 shown with little or no visor forming.
Figure 5:
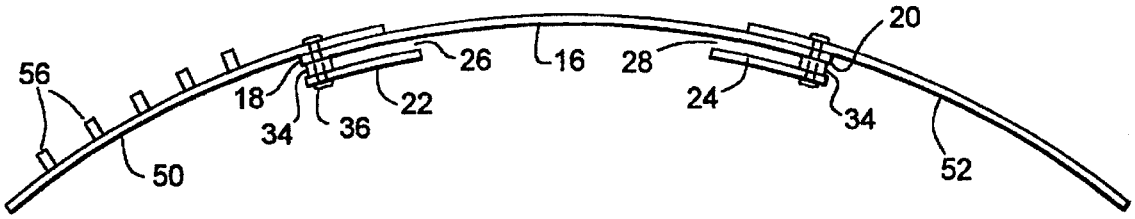
FIG. 5 is a front elevation view of the hat visor forming apparatus of FIG. 4.

Left and right lower retention plates 22 and 24 are rigidly mounted along the respective upper member side edges 18 and 20. More particularly, plates 22 and 24 are spaced from upper member 16 to define opposed left and right visor receiving slots 26 and 28 therebetween (FIG. 5). As best shown in FIG. 2, the cap visor 14 is received and retained within these slots 26 and 28 during visor reformation or during storage of the cap (i.e. when the present invention is utilized in its hat storage capacity).

As noted, the cap and visor 14 is inserted into the bill bender 10 in the direction illustrated by arrow 30. To facilitate the receipt of the bill into slots 26 and 28, it is preferable that the receiving end 32 of the slots be defined by either the upper flexible member 16 or the retention plates 22 and 24 extending outwardly from the other. FIG. 4 illustrates the alternative in which retention plates 22 and 24 extend outwardly (upwardly as shown in the figure) past the upper member 16 whereby the bill is first positioned on, and urged against, the retention plates as it is thereafter urged downwardly (in the direction of arrow 30 into the bender receiving slots 26 and 28. Such a staggered geometry serves to guide the bill into the slots thereby requiring little or no precision or training in use. Again, the upper bill could similarly be extended outwardly of the retention plates to the same benefit and end.

As shown in FIG. 5, retention plates 22 and 24 are positioned in spaced apart, generally parallel relationship to the upper member 16 by spacers 34. Spacers 34 may be of virtually any rigid material and the precise geometry is not critical so long as the spacers do not extend into slots 26 and 28 to thereby block entry of the bill therein. In one preferred arrangement, spacers 34 are simple washers held in position by rivets 36 that extend through the retention plates and upper member thereby serving not only to retain the spacers, but importantly, to rigidly affix the retention plates in proper spaced relationship along the edges of the upper member. It will be appreciated that other methods of rigidly interconnecting the upper member, spacers, and retention plates are contemplated by this invention. Indeed, the entire assembly could be molded or extruded as an integral assembly thereby obviating rivets or other extrinsic connection systems.

Figure 6:
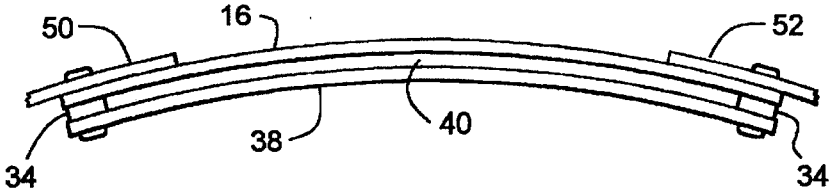
FIG. 6 is a front elevation view of an alternative embodiment of the hat visor forming apparatus of the present invention utilizing spaced apart upper and lower members to define a hat receiving slot or channel therebetween.

FIG. 6 illustrates an alternative embodiment of the present invention in which the separate retention plates 22 and 24 have been replaced by a single lower flexible member 38 which, in turn, defines a single visor receiving slot 40. Flexible members 16 and 38 are held in spaced apart parallel relationship as discussed above with spacers 34 and rivets 36. Again, the entire structure comprising members 16 and 38 and spacers 34 could alternatively be fabricated as an integral unit, for example, by extrusion.

Figure 7:
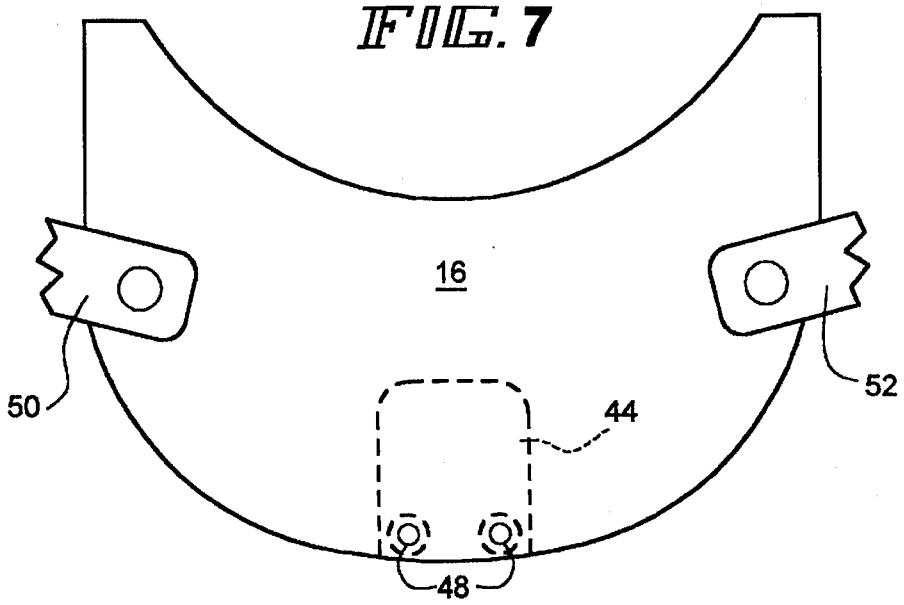
FIG. 7 is horizontal plan view of yet another alternative embodiment of the hat visor forming apparatus depicting a single central visor retaining member.
Figure 8:
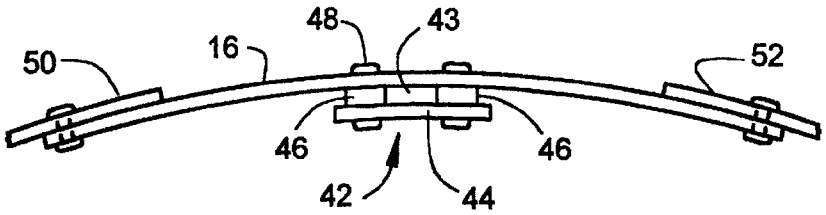
FIG. 8 is a front elevation view of the apparatus of FIG. 7.

Yet another embodiment of the present invention is shown in FIGS. 7 and 8 in which the opposed side retention plates 22 and 24 (of FIGS. 1, 2 and 4) have been replaced by a single central retention post 42. Post 42 is comprised of a retention finger 44 mounted at one end thereof (in cantilever fashion) to the upper member 16 while being spaced therefrom through the use of spacers 46 and rivets 48 substantially as described above with reference to the retention plates of FIG. 1. Post 42 defines a slot 43 between finger 44 and member 16 into which the front of the cap visor is positioned and received.

While the several embodiments described above teach alternative ways to construct a slot for receiving and retaining the visor, it will be appreciated that the visor may be held adjacent the bill bender 10, or the upper flexible member 16 of the bill bender, using any convenient grasping, clipping, or clamping means, for example, spring-loaded clips or clips fabricated from spring steel or the like. Further, the slots disclosed herein may be 'releasable', that is, the slot(s) may be opened to facilitate the positioning of the visor in proper orientation within the bill bender, thereafter, the slot(s) may be closed by, for example, pivoting, rotating, or snapping the retention plates (e.g. 22 and 24) or the retention finger (e.g. 44) into position.

Figure 3:
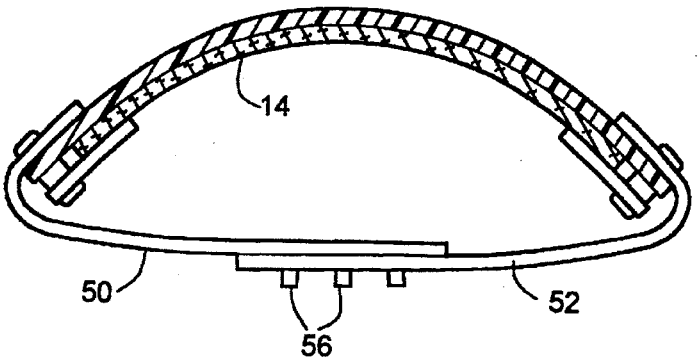
FIG. 3 is a sectional view of the visor forming apparatus taken along line 2—2 of FIG. 1 shown with tension applied to the forming apparatus thereby providing visor forming.

All of the above described embodiments incorporate a tensioning device that permits the increasing, and maintaining, of the curvature of the cap visor, for example, as shown in FIG. 3 (and as contrasted to FIG. 2). The tensioning device may preferably be a pair of straps 50 and 52, one each affixed to respective left and right edges 18 and 20 of the upper member 16. Rivets 54 may again be used and, further, these rivets 54 may advantageously 'double' in the capacity of rivets 36 to secure the retention plates, spacers, and upper and lower members to one-another.

Tensioning straps 50 and 52 may be fabricated of any flexible material including the various woven straps well-known in the marketplace. A buckle or other slip-type strap latch, again of well-know design (not shown), retains the straps in the desired tensioned condition. Alternatively, and a preferred arrangement, is the plastic strap with integral adjustment latch shown in the figures herein. This strap/latch has, in fact, commonly been used at the back of baseball caps to facilitate the size adjustment thereof. The straps are typically molded and define male and female pairs. The male member, shown at 50, includes a plurality of evenly spaced molded bosses or posts 56 that are adapted to be received into, and form a friction fit with, corresponding and equally spaced holes 58 in the female member 52. It will be appreciated that virtually any tensioning device may be employed including, for example flexible cording. It will also be understood that a single tensioning device may be employed in which the tensioning device extends from one side of the present bill bender 10 to the other side, at which other side a latch to retain the tension device is included. For example, a string or cord tensioning device—attached to one side of the bill bender—may be passed through a grommet on the other side and cinched tight as required.

Figure 9:
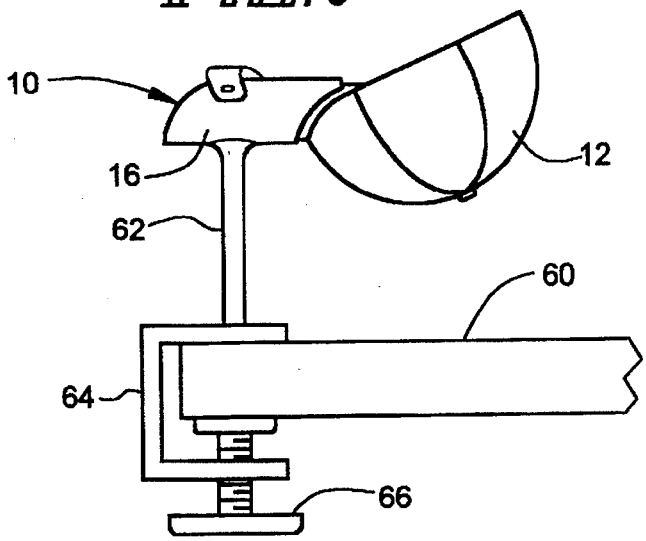
FIG. 9 is a side elevation view of the apparatus of the present invention including a closet shelf mounting bracket; and, FIG. 10 is a side elevation view of the apparatus of the present invention including a closet pole hanging hook.
Figure 10:
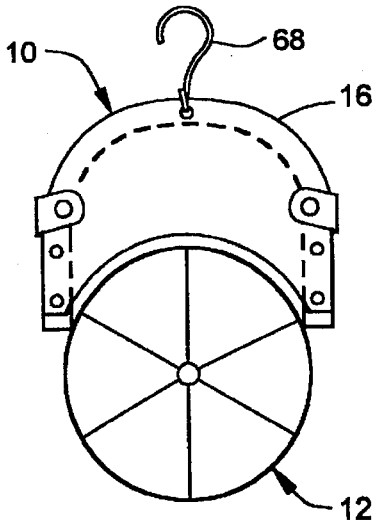

FIGS. 9 and 10 illustrate alternative arrangements for mounting and using the present bill bending apparatus as a means for storing caps in a closet. It will be understood that such storage not only provides a tidy system of cap storage but, by placing the cap within the present apparatus during periods of non-use, maintenance of the desire visor curvature can be assured.

Referring specifically to FIG. 9, the present bill bender 10 is shown space above and mounted to a closet shelf 60 through a vertical post 62 and C-shaped clamp 64. Post 62 is rigidly affixed to the upper flexible member 16 of the present bill bender and to the C-shaped clamp 64. Clamp 64 includes a threaded compression device 66 which, in conventional manner, may be screwably advanced to tightly grip the shelf, securing the entire bill bender assembly thereto. The bill bender 10 may be oriented in any direction on post 62 as is deemed most convenient.

FIG. 10 depicts an alternative arrangement for retaining the bill bender in a closet for the storage of a baseball cap therein. And includes a generally conventional hook 68 attached to the upper flexible member 16. Hook 68 is hung in the conventional manner from the closet cloths bar. It is intended that the bill bender shall remain mounted or hanging and that the cap may effortless be removed and reinserted as necessary. With the tensioning straps engaged, friction between the visor and bill bender apparatus serves to retain the cap without further locking required.

The method of the present invention includes placing the forward portion of the visor requiring reformation adjacent the receiving end 32 of the bill bender (FIG. 4) and urging the visor, in the direction of arrow 30, into slots 26, 40, or 43 until the bill is fully received, as shown in FIG. 1, therein. The present method may also be practiced by moisturizing the visor prior to inserting it into bill bender 10 as described above. Moisturizing has been found to aid in assuring that the visor will take a semi-permanent 'set' generally at the angular contour selected during practice of the present method. This, in turn, lessens the likelihood of having to repeat, or increases the period between repeat applications of, the present bill bender and method. Moisturizing may be performed in any manner and to any degree, e.g. by sprinkling, spraying or even dipping the visor in water, provided however, that care should be exercised to guard against visor warping or disfiguration or discoloration of the visor or logo screened thereon as may be experienced with certain visor materials and screening systems.

Following moisturization, if applied, and the positioning of the visor in the bill bender, the tensioning mechanism, e.g. straps 50 and 52, is engaged to draw the respective sides 18 and 20 into closer proximity thereby correspondingly causing the bill bender, with visor 14 therein, to assume a more contoured, narrow radius curvature. Referring to FIGS. 2 and 3, for example, as the straps are tensioned, the visor is flexed and bent from the relatively flatter profile shown in FIG. 2, to the relatively greater curvature profile of FIG. 3. While any new and greater curvature may be selected, it is generally preferable to select a lesser curvature initially. Thereafter, if the initially selected curvature is not deemed sufficient, the present method can again be applied—but at progressively greater curvatures—until the desire ultimate curvature is attained. Whatever the selected curvature, the tensioning straps are locked at such selected tension until completion of the first phase of visor reformation.

Typically the visor is left in the bill bender for a period of hours or overnight. Where moisturization has been applied, the visor preferably remains in the present apparatus until the visor has completely dried. Thereafter, the visor may be removed either by releasing the tensioning strap latch or, simply, by drawing the hat and visor from the bill bender, i.e. in the direction opposite arrow 30.

If the visor has, in fact, assumed a semi-permanent set according to the contour of the bill bender, the visor may simply be reinserted into the previously tensioned apparatus of the present invention either for storage (which use of the bill bender helps assure that the previously 'set' visor contour will remain) or for further reformation operations according to the present method. If, on the other hand, due to the 'memory' of the visor material or otherwise, the visor has not fully assumed the new contour but has, therefore, partially returned to its original comparatively flat contour, the tensioning straps may preferably be loosened prior to reinsertion of the visor therein. Where the visor material has been determined to exhibit 'memory', a greater angular contour (than ultimately desired) may be set in the expectation that, due to such memory, the visor will in fact lose some of its curvature after removal from the present apparatus thereby assuming the lesser curvature actually desired.

While the preferred embodiments have been described, various alternative embodiments may be utilized within the scope of the invention which is limited only by the following claims and their equivalents.

I claim:

1. Apparatus for reforming the curvature of a visor era standard baseball hat, the visor being attached to and extending from the hat and defining a front end and left and right sides which are curved inwardly, the visor reforming apparatus comprising a first curved flexible member in the shape of the visor, the flexible member having opposed ends; means for attaching the first flexible member to a visor whereby the opposed ends are positioned respectively adjacent said visor left and right sides; at least two coacting elongate tensioning members each having first and second ends; means for attaching the first ends of each tensioning member to the opposed ends of the first flexible member; adjustable means for interconnecting the second ends of each tensioning member in direct overlapping contact with each other and for drawing the first ends of each tensioning member closer together whereby the first flexible member and visor attached thereto shall define a generally arcuate contour as the opposed ends are drawn closer together; said adjustable means including means for locking the tensioning members in a tensioned position wherein the first flexible member and visor shall be maintained in the drawn arcuate contour until the locking means is released whereby a semi-permanent curvature may be placed in the visor.

2. The visor reforming apparatus of claim 1 in which the means for attaching the first flexible member to the visor includes a second flexible member; means for mounting the second flexible member in generally parallel spaced apart relationship to the first flexible member whereby said space between the flexible members defines a visor channel for receiving and retaining the visor therein during the reforming of the visor.

3. The visor reforming apparatus of claim 1 in which the means for attaching the first flexible member to the visor includes finger means, means for mounting the finger means in spaced apart relationship to the first flexible member, the finger means being mounted generally in the middle between the opposed ends of the first flexible member, said space between the finger and first flexible member defines a visor slot for receiving and retaining the visor therein during the reforming of the visor.

4. The visor reforming apparatus of claim 1 in which the means for attaching the first flexible member to the visor includes left and right retention members, means for mounting the left and right retention members in spaced apart relationship to the first flexible member at the respective opposed ends thereof, said spaces between the retention members and first flexible member define respective left and right visor slots for receiving and retaining the visor therein during the reforming of the visor.

5. The visor reforming apparatus of claim 4 in which retention members include lip means extending outwardly of the first flexible member in the direction from which the visor shall be inserted, said lip means serving as a guide to direct the visor into the slots upon insertion of the visor into the present reforming apparatus.

6. The visor reforming apparatus of claim 4 in which first flexible member includes lip means extending outwardly of the retention members in the direction from which the visor shall be inserted, said lip means serving as a guide to direct the visor into the slots upon insertion of the visor into the present reforming apparatus.

7. The visor reforming apparatus of claim 1 in which the tensioning members include first and second straps operatively attached to respective opposed ends of the first flexible member.

8. The visor reforming apparatus of claim 1 in which the tensioning members include cord means attached to one of said opposed first flexible member ends and the locking means and means on the other of said opposed flexible member ends to receive the cord means.

9. The visor reforming apparatus of claim 1 further including stand-off means having first and second ends, means for rigidly attaching the first end thereof to the reforming apparatus and means for attaching the second thereof to a surface whereby the visor reforming apparatus may be fixed mounted to said surface thereby additionally functioning as a rack to hold a cap.

10. The visor reforming apparatus of claim 1 further including hook means connected thereto whereby the reforming apparatus may be hung from a closet pole or other member.

11. Apparatus for reforming the curvature of a visor of a standard baseball hat, the visor being attached to and extending from the hat and defining a front end and left and right sides which are curved inwardly, the visor having a width defined as the distance between the left and right sides, the visor reforming apparatus comprising a curved flexible member in the shape of the visor, the flexible member having opposed ends spaced apart a distance greater than the width of the visor; left and right retention means; means for connecting the left and right retention means in spaced apart relationship to the flexible member adjacent, respectively, the opposed ends whereby said spaces between the flexible member and the left and right retention means define means for receiving and retaining a visor; at least two coacting elongate tensioning members each having first and second ends; means for attaching the first ends of each tensioning member to the opposed ends of the flexible member; adjustable means for interconnecting the second ends of each tensioning member in direct overlapping contact with each other and for drawing the first ends of each tensioning member closer together whereby the flexible member and visor attached thereto shall define a generally arcuate contour as the opposed ends are drawn closer together; said adjustable means including means for locking the tensioning members in a tensioned position wherein the flexible member and visor shall be maintained in the drawn arcuate contour until the locking means is released whereby a semi-permanent curvature may be placed in the visor.

12. A method for reforming the curvature of a visor of a hat including providing a device for reforming the curvature of a visor of a standard baseball hat, the visor being attached to and extending from the hat and defining a front end and left and right sides which are curved inwardly, the visor reforming apparatus comprising a first curved flexible member in the shape of the visor, the flexible member having opposed ends; means for attaching the first flexible member to a visor whereby the opposed ends are positioned respectively adjacent said visor left and right sides; at least two coacting elongate tensioning members each having first and second ends; means for attaching the first ends of each tensioning member to the opposed ends of the first flexible member; adjustable means for interconnecting the second ends of each tensioning member in direct overlapping contact with each other and for drawing the first ends of each tensioning member closer together whereby the first flexible member and visor attached thereto shall define a generally arcuate contour as the opposed ends are drawn closer together; said adjustable means including means for locking the tensioning members in a tensioned position wherein the first flexible member and visor shall be maintained in the drawn arcuate contour until the locking means is released whereby a semi-permanent curvature maybe placed in the visor; attaching the visor of the hat to the flexible member whereby when said flexible member is flexed, the visor flexes correspondingly; causing the flexible member to be flexed to a first curvature whereby the curvature of the visor is increased; maintaining the flexible member and visor in said flexed orientation for a predetermined interval; unattaching the visor from the flexible member.

13. The method for reforming the curvature of a visor of a hat of claim 12 including the further step of moisturizing the visor prior to attachment to the flexible member.

14. The method for reforming the curvature of a visor of a hat of claim 12 including reattaching the visor of the hat to the flexible member and causing the flexible member to be flexed to a second curvature, the second curvature being greater than the first curvature whereby the curvature of the visor may be progressively increased.

15. The method for reforming the curvature of a visor of a hat of claim 12 including repeating plural times the steps of attaching the visor to the flexible member and causing the flexible member to be flexed and unattaching the flexible member and further including that each successive flexing of the flexible member shall be at a progressively greater angular curvature.

16. The method for reforming the curvature of a visor of a hat of claim 12 in which the step of attaching the visor includes the step of sliding the visor into slots located at opposed ends of the flexible member whereby the slots serve to retain and attach the visor to the flexible member.

17. The method for reforming the curvature of a visor of a hat of claim 12 in which the step of attaching the visor includes the step of sliding the visor into a slot located generally in the middle of the flexible member between the opposed ends thereof whereby the slot serves to retain and attach the visor to the flexible member.

18. The method for reforming the curvature of a visor of a hat of claim 12 in which the step of causing the flexible member to be flexed includes the step of actuating a tensioning device to draw opposed ends of the flexible member toward one another thereby increasing the curvature of the flexible member and visor.

19. The method for reforming the curvature of a visor of a hat of claim 18 in which the step of maintaining the flexible member and visor in a flexed orientation includes the step of actuating a latch associated with the tensioning device whereby the tensioning device will be maintained in its actuated position thereby maintaining the opposed flexible member ends in said drawn toward one another position.

* * * * *